US007822619B2

(12) United States Patent
Davidson et al.

(10) Patent No.: US 7,822,619 B2
(45) Date of Patent: Oct. 26, 2010

(54) METHOD AND APPARATUS FOR PROVIDING CONTEXT-SENSITIVE COMMUNITY LINKS

(75) Inventors: Harold R. Davidson, American Fork, UT (US); Jason A. Hunter, Oren, UT (US); Jeffrey D. Campbell, Cedar Hills, UT (US); Michael A. Scalora, Orem, UT (US); David A. Duncan, Orem, UT (US); Bradley G. Keck, Cupertino, CA (US)

(73) Assignee: Intuit Inc., Mountain View, CA (US)

( * ) Notice: Subject to any disclaimer, the term of this patent is extended or adjusted under 35 U.S.C. 154(b) by 1324 days.

(21) Appl. No.: 11/332,571

(22) Filed: Jan. 12, 2006

(65) Prior Publication Data

US 2007/0162294 A1 Jul. 12, 2007

(51) Int. Cl.
*G06Q 99/00* (2006.01)

(52) U.S. Cl. ..... 705/1.1

(58) Field of Classification Search ..... 705/1.1
See application file for complete search history.

(56) References Cited

U.S. PATENT DOCUMENTS

2002/0059193 A1* 5/2002 Decime ..... 707/3
2003/0120557 A1* 6/2003 Evans et al. ..... 705/26

* cited by examiner

*Primary Examiner*—Jonathan Ouellette
(74) *Attorney, Agent, or Firm*—Park, Vaughan, Fleming & Dowler LLP

(57) ABSTRACT

One embodiment of the present invention provides a system that provides a context-sensitive "community link," which enables a system or application user to easily access a community forum related to a specific system or application feature. During operation, the system provides a user with access to the system or application feature. While providing such access, the system displays a community link to the user, wherein the community link is directed to a community forum associated with the system or application feature. When the user selects the community link, the system navigates the user to the community forum associated with the system or application feature, so that the user can exchange information with other users about the system or application feature.

27 Claims, 4 Drawing Sheets

METHOD AND APPARATUS FOR PROVIDING CONTEXT-SENSITIVE COMMUNITY LINKS

BACKGROUND

Related Art

The present invention relates to mechanisms for providing "help information" for computer system features.

When computer users have problems using a specific application (or system) feature, they often turn to a "help system" associated with the application to obtain information that can be used to solve their problems. Unfortunately, most help systems only contain information about commonly-occurring and well-known problems associated with the application feature. Hence, these help systems do not provide relevant information for solving less-frequently occurring problems, or problems that were not contemplated at the time the help information was assembled.

For these other types of problems, relevant information can often be obtained from online "community forums," in which groups of users discuss specific application topics. Within such a forum, a user can ask other users for help with a specific problem with an application feature, or can obtain information from previous discussions about the application feature.

Many users may not be aware of the existence of such community forums. Furthermore, even users that are aware of these forums may still have trouble finding the right forum in which to discuss their specific problems.

SUMMARY

One embodiment of the present invention provides a system that provides a context-sensitive "community link," which enables a system or application user to easily access a community forum related to a specific system or application feature. During operation, the system provides a user with access to the system or application feature. While providing such access, the system displays a community link to the user, wherein the community link is directed to a community forum associated with the system or application feature. When the user selects the community link, the system automatically navigates the user to the community forum associated with the system or application feature, so that the user can exchange information with other users about the system or application feature.

In a variation on this embodiment, providing the user with access to the system or application feature involves: allowing the user to access a user interface for the system or application feature; or providing a link to the system or application feature.

In a variation on this embodiment, when the user selects the community link, a request is sent to a mapping server to link to the community forum associated with the system or application feature. This request includes an identifier for the system or application feature. Next, the mapping server performs a mapping operation based on the identifier to identify a matching community forum, and then directs the request to the matching community forum.

In a further variation, when a new community forum which relates to system or application features becomes available, the mapping server allows an administrator to map identifiers for specific system or application features to the new community forum.

In a further variation, the identifier for the system or application feature is embedded in a Universal Resource Locator (URL) associated with the request.

In a variation on this embodiment, navigating the user to the community forum associated with the system or application feature involves: presenting the user with links to one or more community forums associated with the system or application feature; allowing the user to select one of the links; and navigating the user to a community forum associated with the selected link.

In a variation on this embodiment, providing the user with access to the system or application feature additionally involves displaying a link directed to help information associated with the system or application feature.

In a variation on this embodiment, the community forum can be hosted on: a community-forum server maintained by the system or application provider; a third-party forum server; or a weblog server for a web log which constitutes the community forum for the system or application feature.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the claims.

The data structures and code described in this detailed description are typically stored on a computer-readable storage medium, which may be any device or medium that can store code and/or data for use by a computer system. This includes, but is not limited to, magnetic and optical storage devices, such as disk drives, magnetic tape, CDs (compact discs), DVDs (digital versatile discs or digital video discs), or any device capable of storing data usable by a computer system.

System

Figure 1:
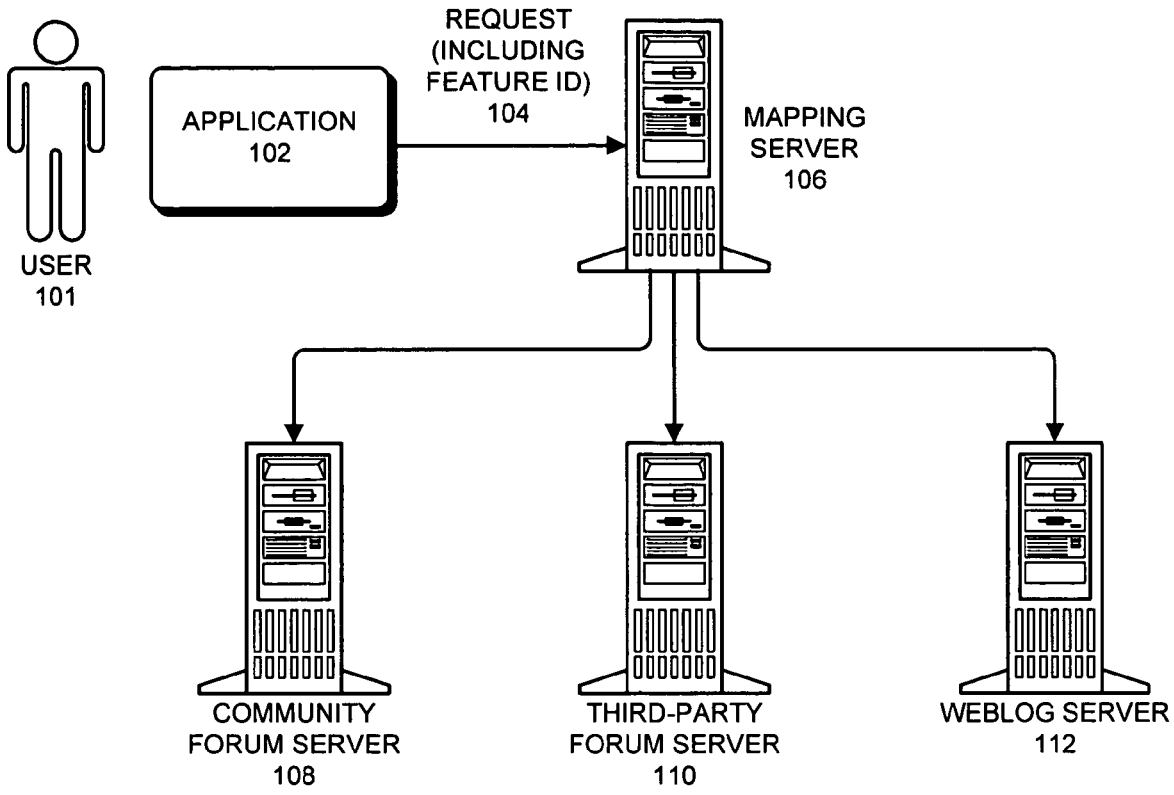
FIG. 1 illustrates a system for providing access to a community forum in accordance with an embodiment of the present invention.

FIG. 1 illustrates a system for providing access to a community forum in accordance with an embodiment of the present invention. Within this system, a user 101 operates an application 102. Application 102 can generally include any type of computer-based program, application or system. For example, application 102 can include: an accounting program, a word-processing program, a computer operating system, or any application or system capable of being executed on a computer system.

When the user selects on a "community link" provided by the application, the system sends a request 104 to a mapping server 106. This request 104 includes a feature identifier, which identifies a specific application feature or application context. This feature identifier can be obtained from context information within application 102. For example, this feature identifier can identify a specific form or feature that application 102 presents to user 101, or some indication of the state of application 102, as well as related data and metadata pertinent to that state.

Mapping server 106 then directs the user to a community forum associated with the application feature. For example, this community forum can be hosted on: a community-forum server 108 maintained by the system or application provider; a third-party forum server 110; a weblog server 112 for a web log which constitutes the community forum for the system or application feature; or any other forum having content generated by a group or individual.

Note that mapping server 106 as well as the servers for the community forum 108, 110 and 112 can be located on different computer systems distributed throughout one or more computer networks. Alternatively, they can be located on the same computer system, or even on the local computer system that hosts application 102.

User Interface

Figure 2:
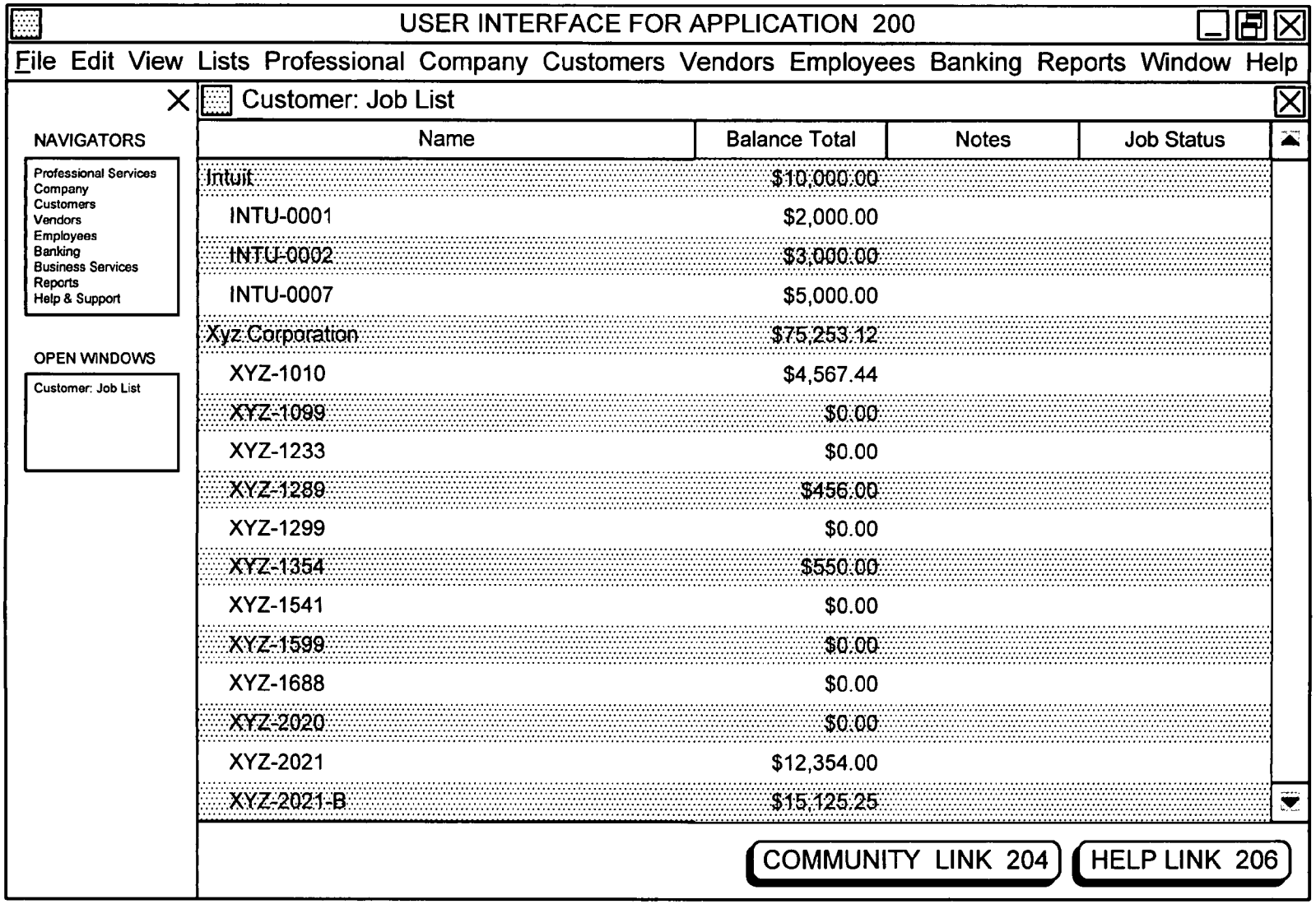
FIG. 2 illustrates a user interface which includes a community link in accordance with an embodiment of the present invention.

FIG. 2 illustrates a user interface 200 with a community link 204 in accordance with an embodiment of the present invention. In the embodiment illustrated in FIG. 2, user interface 200 comprises a "form" that allows the user to interact with a specific application feature. As is illustrated in FIG. 2, form 200 includes various form fields that allow the user to view and access data values associated with the application feature. Form 200 additionally includes an icon (or any other possible representation) for a community link 204. Form 200 also includes a help link, which allows the user to access help information associated with the application feature.

Linking to a Community Forum

Figure 3:
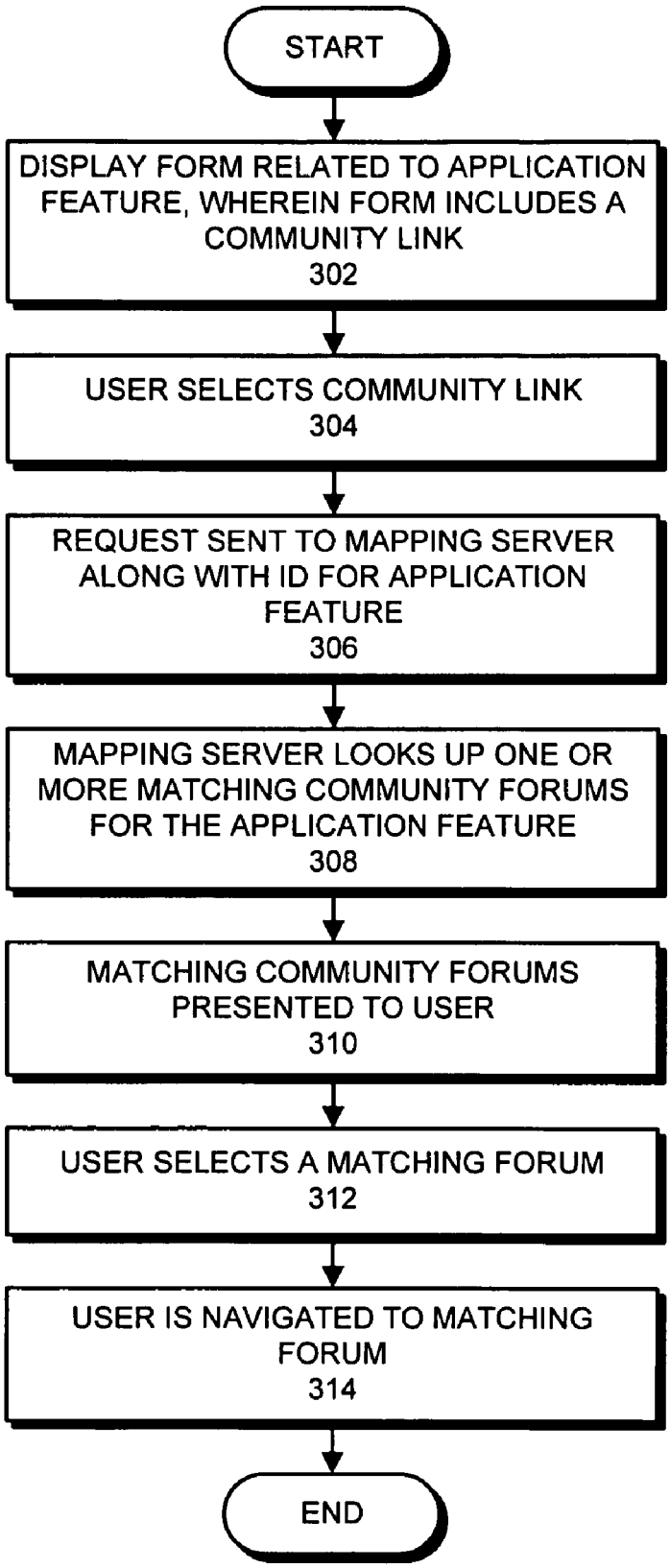
FIG. 3 presents a flow chart illustrating the process of providing access to a community forum through a community link in accordance with an embodiment of the present invention.

FIG. 3 presents a flow chart illustrating the process of providing access to a community forum through a community link in accordance with an embodiment of the present invention. First, the system displays a form (or other type of user interface element) related to the application feature (step 302). This form includes a community link as is illustrated in FIG. 2.

Next, the user selects the community link (step 304), for example by clicking on the community link using a pointing device such as a mouse. This causes the application (or the operating system) to send a request to mapping server 106 along with a feature identifier for the application feature (step 306).

Next, mapping server 106 looks up one or more matching community forums associated with the application feature (step 308). This lookup process can involve accessing any type of know lookup structure or database that can map a feature identifier to relevant community forums. Note that this mapping can be many-to-one, wherein many different feature identifiers map to the same community forum. This mapping can also be one-to-many, wherein a single feature identifier maps to multiple community forums.

In the case where multiple matching community forums are returned by this lookup process, the system can present a list of the matching community forums to the user (step 310), and the user can select one of the matching forums (step 312).

Next, the user is navigated to the matching community forum (step 314). In one embodiment of the present invention, navigating the user to the matching community forum involves performing a "web redirection" operation to redirect the user to a web server that hosts the community forum.

Note that if user-ratings information for the community messages can be obtained, the community sites can send this user-ratings information to mapping server 106, where the user-ratings information can be used to influence the order of the relevant links that are presented to the user. For example, the best-rated links can be moved to the top of the list. Also note that after the user navigates to a specific community forum, user-ratings information can be used by the forum to determine how content items are presented to the user.

In general, note that it is possible for the system to use experience gained through previous user's searches to recommend searches and community ideas to other users. For example, the system can tell the user that a previous user who asked a similar question also had specific related questions/ideas and also looked at other links. Such recommendations can be produced by the community site itself. Alternatively, before the user even arrives at a specific community site, if historical search data on the individual community sites is available to mapping server 106, mapping server 106 can automatically append relevant links based on actions of users of the community sites. This technique can be expanded to include auto-generated links using other relevancy heuristics, such as keyword matching, etc.

One embodiment of the present invention enables Value-Added ReSellers (VARS) and application users to easily update and change the community pages. For example, the mapping server 106 can return editable templates to display community links. These editable templates can enable VARS and application users to put their brand or additional help resources on the page that shows the returned links. Alternatively, the system can enable VARS or application users to send information to the community forum servers, which the community forum servers use to update or change the appearance of the community pages.

Accommodating a New Community Forum

Since forum topics can subdivide and otherwise morph over time, the mappings (within mapping server 106) can be modified to map feature identifiers to new forum topics. These mappings from feature identifiers to topics can be maintained by people who operate the community forums. In this way, if a new topic springs up, community links associated with related features of the application can immediately be rerouted to the new community forum associated with the new topic.

Figure 4:
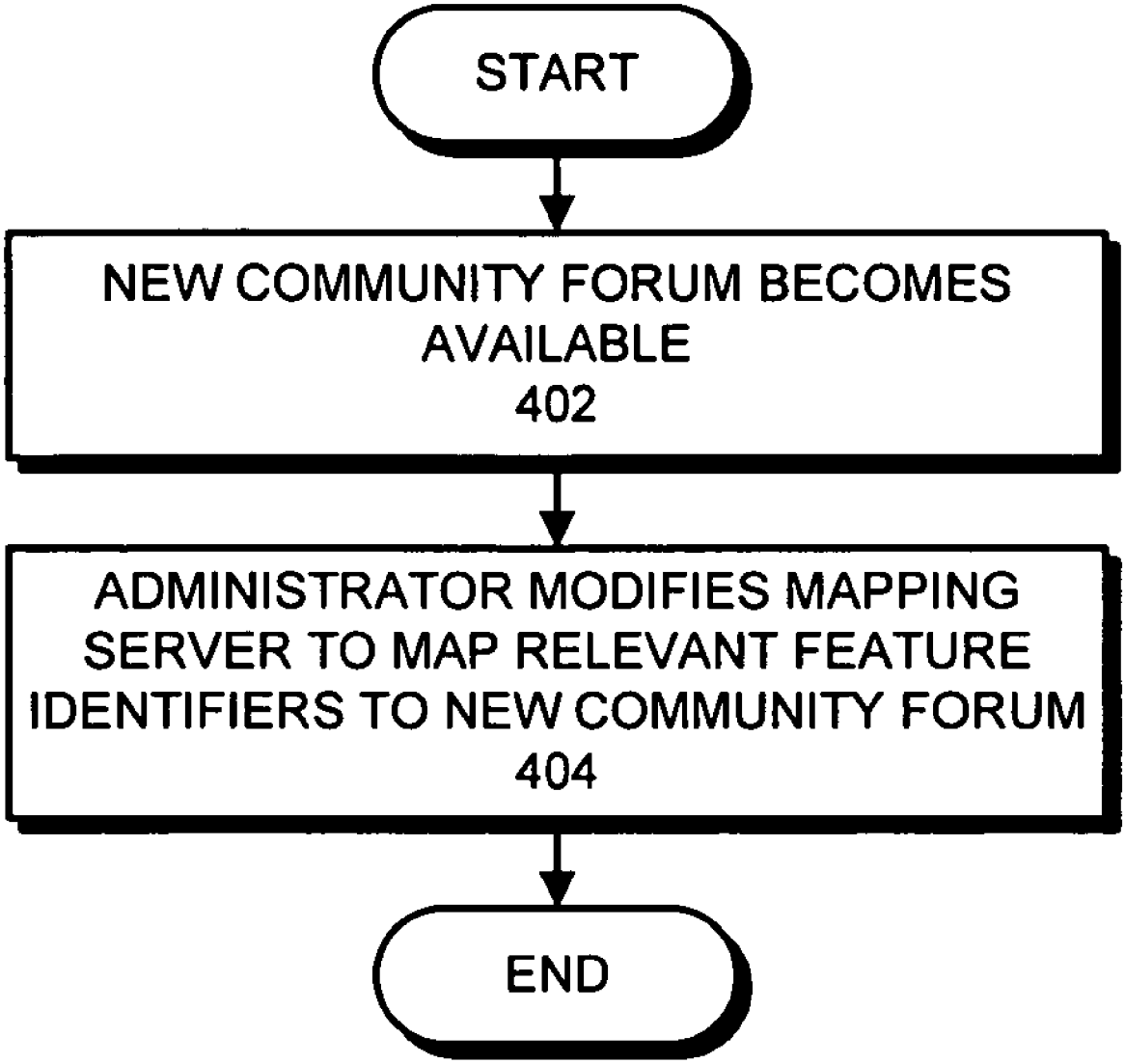
FIG. 4 presents a flow chart illustrating the process of modifying a mapping server to accommodate a new community forum in accordance with an embodiment of the present invention.

More specifically, FIG. 4 presents a flow chart illustrating the process of modifying the system to accommodate a new community forum in accordance with an embodiment of the present invention. This process starts when one or more new community forums become available (step 402). At this point, a system user or administrator modifies mapping server 106 so that it maps relevant feature identifiers to the new community forums (step 404).

For example, if a new community forum specifically directed to transferring inventory is created for an accounting program, then a feature identifier associated with transferring inventory can be associated with the specific community forum related the transferring inventory, instead of a more general community forum related to the general topic of inventory.

Other Extensions

In another embodiment of the present invention, community links are displayed inside "help pages" for an application. This makes the community links somewhat "context-sensitive," because the help pages themselves are context-sensitive, and the community links are attached to associated help pages.

In this embodiment, the help text viewer can dynamically query the mapping server 106 to check for new or updated community links that could dynamically be added to the help page contents. For example, a help text viewer can perform this query by communicating via the HyperText Transfer Protocol (HTTP) to mapping server 106 in the same way that a browser does. The results of this query can then be incorporated into the help text.

However, the above-described technique for placing community links within help pages has a number of disadvantages. It "buries" the cue that there is a community link readily available within the help pages. Moreover, the topic coverage for each forum may not match up 1-to-1 with topic coverage of context-sensitive help screens. There may be fewer "community" links than there are "help" pages, for instance, or the topics may be partitioned in a different way.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A method for providing a community link for accessing a community forum, the method comprising:

providing a user with an application interface for accessing to the application feature;

displaying a community link in the application interface for accessing the community forum;

determining a feature identifier based on the content displayed in the application interface; and responsive to the user selecting the community link, redirecting the user to a community forum page which is associated with the determined feature identifier, thereby allowing the user to exchange information with other users about the application feature.

2. The method of claim 1, wherein providing the application interface for accessing the application feature involves providing a link to the application feature.

3. The method of claim 1, further comprising sending a request that includes the feature identifier to a mapping server, which performs a mapping operation based on the feature identifier to identify a community forum page associated with the application feature and redirects the request to the community forum page.

4. The method of claim 3, wherein when a new community forum which relates to application features becomes available, the mapping server allows an administrator to map feature identifiers for specific application features to the new community forum.

5. The method of claim 3, wherein the feature identifier for the application feature is embedded in a Universal Resource Locator (URL) associated with the request.

6. The method of claim 1, wherein redirecting the user to the community forum associated with the application feature involves:

presenting the user with links to one or more community forums associated with the application feature;

allowing the user to select one of the links; and navigating the user to a community forum associated with the selected link.

7. The method of claim 1, wherein providing the user with access to the application feature additionally involves displaying a link directed to help information associated with the application feature.

8. The method of claim 1, wherein the community forum is hosted on:

a community-forum server maintained by the application provider;

a third-party forum server; or a weblog server for a web log which constitutes the community forum for the application feature.

9. The method of claim 1, wherein displaying the community link in the application interface to the user, or redirecting the user to the community forum, involves presenting information to the user based on user ratings of the community links and/or community messages.

10. A non-transitory computer-readable storage medium storing instructions that when executed by a computer cause the computer to perform a method for providing a community link for accessing a community forum, the method comprising:

providing a user with an application interface for accessing to the application feature;

displaying a community link in the application interface for accessing the community forum;

determining a feature identifier based on the content displayed in the application interface; and responsive to the user selecting the community link, redirecting the user to a community forum page which is associated with the determined feature identifier, thereby allowing the user to exchange information with other users about the application feature.

11. The computer-readable storage medium of claim 10, wherein providing the application interface for accessing the application feature involves providing a link to the application feature.

12. The computer-readable storage medium of claim 10, further comprising sending a request that includes the feature identifier to a mapping server, which performs a mapping operation based on the feature identifier to identify a community forum page associated with the application feature and redirects the request to the community forum page.

13. The computer-readable storage medium of claim 12, wherein when a new community forum which relates to application features becomes available, the mapping server allows an administrator to map feature identifiers for specific application features to the new community forum.

14. The computer-readable storage medium of claim 12, wherein the feature identifier for the application feature is embedded in a Universal Resource Locator (URL) associated with the request.

15. The computer-readable storage medium of claim 10, wherein navigating redirecting the user to the community forum associated with the application feature involves:

presenting the user with links to one or more community forums associated with the application feature;

allowing the user to select one of the links; and navigating the user to a community forum associated with the selected link.

16. The computer-readable storage medium of claim 10, wherein providing the user with access to the application feature additionally involves displaying a link directed to help information associated with the application feature.

17. The computer-readable storage medium of claim 10, wherein the community forum can be hosted on:

a community-forum server maintained by the application provider;

a third-party forum server; or a weblog server for a web log which constitutes the community forum for the application feature.

18. The computer-readable storage medium of claim 10, wherein displaying the community link in the application interface to the user, or redirecting the user to the community forum, involves presenting information to the user based on user ratings of the community links and/or community messages.

19. An apparatus that provides a community link for accessing a community forum, the apparatus comprising:

an access mechanism configured to provide a user with an application interface for accessing to the application feature;

additionally display mechanism configured to display a community link in the application interface for accessing the community forum;

a determining mechanism configured to determine a feature identifier based on the content displayed in the application interface; and a redirection mechanism, wherein responsive to the user selecting the community link, the redirection mechanism is configured to redirect the user to a community forum page which is associated with the determined feature identifier, thereby allowing the user to exchange information with other users about the application feature.

20. The apparatus of claim 19, wherein providing the application interface for a accessing the application feature involves providing a link to the application feature.

21. The apparatus of claim 19, further comprising, the redirection mechanism is configured to send a request that includes the feature identifier to a mapping server, which performs a mapping operation based on the feature identifier to identify a community forum page associated with the application feature and redirects the request to the community forum page.

22. The apparatus of claim 19, wherein the redirection mechanism is configured to:

present the user with links to one or more community forums associated with the application feature;

allow the user to select one of the links; and to redirect the user to a community forum associated with the selected link.

23. An apparatus that facilitates providing a community link for accessing a community forum, the apparatus comprising:

a mapping server;

wherein upon receiving a request to link to a community forum associated with an application feature, the mapping server is configured to automatically, perform a mapping operation based on a feature identifier for the application feature to identify a matching community forum, wherein the feature identifier is based on the content displayed in an application interface, and to direct the request to the matching community forum.

24. The apparatus of claim 23, wherein the request to link to the community forum is generated by a client when a user selects a community link displayed along with the application feature.

25. The apparatus of claim 23, wherein the mapping server is configured to allow an administrator to map feature identifiers for specific application features to a new community forum when the new community forum becomes available.

26. The apparatus of claim 23, wherein the feature identifier for the application feature is embedded in a Universal Resource Locator (URL) associated with the request.

27. The apparatus of claim 23, wherein the community forum is hosted on:

a community-forum server maintained by the application provider;

a third-party forum server; or a weblog server for a web log which constitutes the community forum for the application feature.

* * * * *

UNITED STATES PATENT AND TRADEMARK OFFICE

CERTIFICATE OF CORRECTION

PATENT NO. : 7,822,619 B2
APPLICATION NO. : 11/332571
DATED : October 26, 2010
INVENTOR(S) : Harold R. Davidson et al.

It is certified that error appears in the above-identified patent and that said Letters Patent is hereby corrected as shown below:

In claim 15 (at column 6, line 57), please delete the word "navigating".

Signed and Sealed this
Eleventh Day of January, 2011

David J. Kappos

David J. Kappos
*Director of the United States Patent and Trademark Office*